US010683625B2

(12) United States Patent
Kulp et al.

(10) Patent No.: US 10,683,625 B2
(45) Date of Patent: Jun. 16, 2020

(54) ANTI-ROTATION WATER-BALLASTED PROTECTION BARRIERS AND METHODS

(71) Applicant: TRAFFIX DEVICES, INC., San Clemente, CA (US)

(72) Inventors: Jack H. Kulp, Dana Point, CA (US); Geoffrey B. Maus, Mission Viejo, CA (US); Felipe Almanza, San Clemente, CA (US); Christopher A. Jaime, San Clemente, CA (US)

(73) Assignee: TrafFix Devices, Inc., San Clemente, CA (US)

( * ) Notice: Subject to any disclaimer, the term of this patent is extended or adjusted under 35 U.S.C. 154(b) by 0 days.

(21) Appl. No.: 16/355,664

(22) Filed: Mar. 15, 2019

(65) Prior Publication Data

US 2019/0301119 A1 Oct. 3, 2019

Related U.S. Application Data

(60) Provisional application No. 62/648,846, filed on Mar. 27, 2018.

(51) Int. Cl.
*E01F 13/02* (2006.01)
*E01F 15/08* (2006.01)

(52) U.S. Cl.
CPC ..... *E01F 15/086* (2013.01); *E01F 13/02* (2013.01); *E01F 15/088* (2013.01)

(58) Field of Classification Search
CPC ..... E01F 13/02; E01F 15/086; E01F 15/088
USPC ..... 404/6
See application file for complete search history.

(56) References Cited

U.S. PATENT DOCUMENTS

| | | | | |
|---|---|---|---|---|
| 4,681,302 | A | 7/1987 | Thompson | |
| 5,425,594 | A | 6/1995 | Krage et al. | |
| 5,605,413 | A * | 2/1997 | Brown | E01F 15/025 256/13.1 |
| 7,144,186 | B1 | 12/2006 | Nolte | |
| 7,234,275 | B1 | 6/2007 | Haggy et al. | |
| 7,654,768 | B1 * | 2/2010 | Tullis | E01F 13/12 256/13.1 |
| 8,491,217 | B2 | 7/2013 | Kulp et al. | |
| 8,647,012 | B2 * | 2/2014 | Wilkinson | E01F 15/12 256/13.1 |
| 8,777,510 | B2 | 7/2014 | Maus et al. | |
| 2007/0253771 | A1 * | 11/2007 | Hotchkin | E01F 15/085 404/6 |
| 2010/0061800 | A1 | 3/2010 | Riddell et al. | |
| 2013/0081348 | A1 | 4/2013 | James | |

(Continued)

OTHER PUBLICATIONS

International Search Report and Written Opinion dated Jun. 14, 2019 in connection with corresponding Application No. PCT/US19/22635.

*Primary Examiner* — Raymond W Addie
(74) *Attorney, Agent, or Firm* — Donald E. Stout; Stout, Uxa & Buyan, LLP

(57) ABSTRACT

Molded plastic barrier segments, typically water or sand-ballasted, are engineered to be attached together, end-to-end, in a barrier array, with innovative features which result in low rotation between attached barrier segments. Such a low rotation barrier array will, upon impact by a vehicle, act as a re-directive barrier, rather than a capturing barrier, which is an important safety feature in some crash scenarios.

15 Claims, 13 Drawing Sheets

(56) References Cited

U.S. PATENT DOCUMENTS

| | | | |
|---|---|---|---|
| 2013/0307181 | A1 | 11/2013 | Kulp et al. |
| 2014/0314479 | A1 | 10/2014 | Stephens et al. |

* cited by examiner

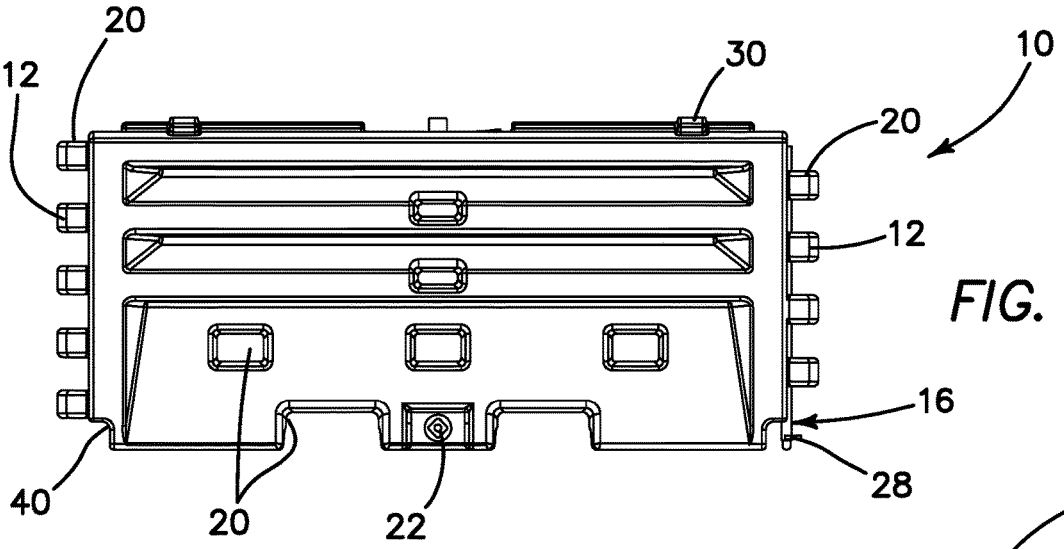
FIG. 12
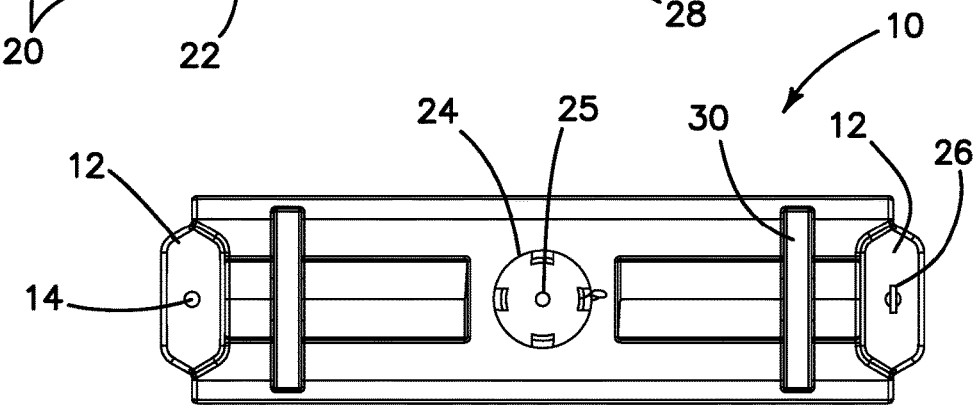
FIG. 13
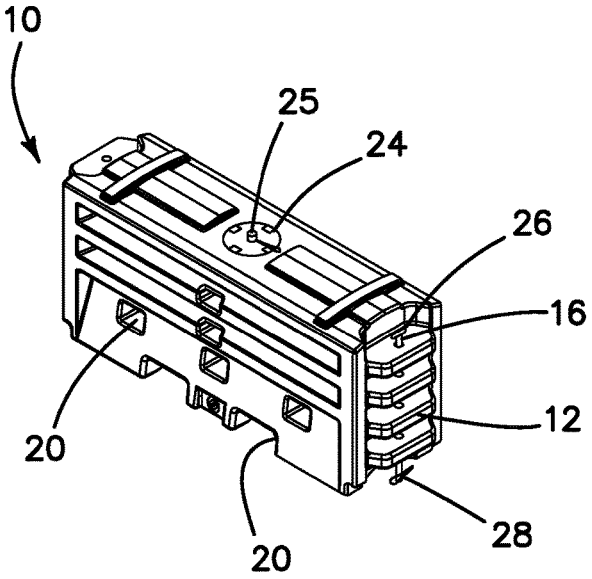
FIG. 14
FIG. 15
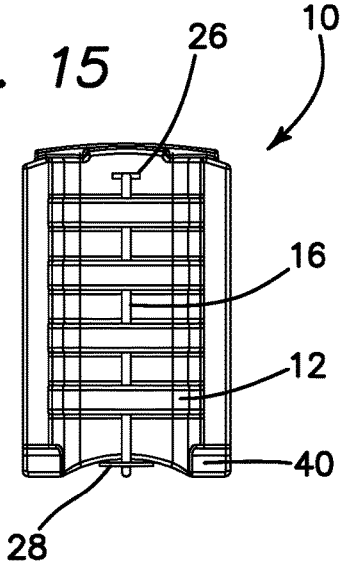

ANTI-ROTATION WATER-BALLASTED PROTECTION BARRIERS AND METHODS

This application claims the benefit under 35 U.S.C. 119 of the filing date of Provisional Patent Application Ser. No. 62/648,846, entitled Anti-Rotation Water-Ballasted Protection Barriers and Methods, filed on Mar. 27, 2018. This application is also related to U.S. Pat. No. 8,491,217, entitled Water-Ballasted Protection Barriers and Methods, filed on Feb. 3, 2010, and U.S. Pat. No. 8,777,510, entitled End Treatments and Transitions for Water-Ballasted Protection Barrier Arrays, filed on Feb. 10, 2012. All of the foregoing applications are commonly assigned with the present application and expressly incorporated herein, in their entirety.

SUMMARY OF THE INVENTION

The present invention comprises a plurality of molded plastic barrier segments which are engineered to be attached together, end-to-end, in a barrier array, as is well known in the art. Such barrier segments are usually water-ballasted, though other ballasts, such as sand, may be used, and the barriers may in some applications be empty. The present invention is particularly concerned with innovative features which result in low rotation between attached barrier segments. Such a low rotation barrier array will, upon impact by a vehicle, act as a re-directive barrier, rather than a capturing barrier, which is an important safety feature in some crash scenarios, particularly with respect to more recent safety specifications such as those required by the U.S. federal MASH certification.

In one aspect of the invention, there is provided a hollow barrier segment which is fillable with a ballasting material for use in assembling an array of hollow barrier segments attached end-to-end to form a barrier wall. The barrier segment comprises a molded plastic container having outer walls defining an interior volume and having a first end and a second end, a plurality of connecting lugs disposed on each of the first and second ends, so that a plurality of barrier segments may be joined together end-to-end. The outer walls comprise side walls which extend beyond each of the first and second ends, to form a recess between the extended side walls on each of the first and second ends. The connecting lugs each have a length, at least one-third of the length of each connecting lug being disposed between the extended side walls within the recess on either the first or the second end, so that no more than two-thirds of the length of each lug extends beyond the extended side walls of the barrier segment. More particularly, between one-third and one-half of the length of each connecting lug is disposed between the extended side walls within the recess on either the first or the second end. In an exemplary embodiment, about one-half of the length of each connecting lug is disposed between the extended side walls within the recess on either the first or the second end. Because of these arrangements, when the hollow barrier segment is joined to another hollow barrier segment end-to-end, the extended side walls of one of the joined barrier segments contact the extended side walls of the other of the joined barrier segments contact one another to create a flush engagement of the joined barrier segments. Alternatively, even if the extended side walls do not actually contact one another, when the hollow barrier segment is joined to another hollow barrier segment end-to-end, the extended side walls of one of the joined barrier segments are sufficiently close to engagement with the extended side walls of the other of the joined barrier segments so that a relative rotation of the joined barrier segments cannot exceed 5 degrees.

Advantageously, a width of each of the connecting lugs extends across an entire width of the recess within which the connecting lugs are disposed, so that each of the connecting lugs joins the extended side walls of the hollow barrier segment. A hole is disposed in each connecting lug for receiving a pin to secure the connecting lugs of adjoining barrier segments together. In some embodiments, each connecting lug comprises a plurality of spaced holes for receiving a plurality of pins to secure the connecting lugs of adjoining barrier segments together. The plurality of spaced holes, in a certain embodiment, comprises three spaced holes.

Another advantageous feature of the invention is the provision of a hand access opening disposed on a lower end of each extended side wall, for permitting access to the pins securing adjoining barrier segments together, even with the extended side walls of those adjoining barrier segments are in flush contact. In some exemplary embodiments, each hand access opening comprises a half-oval, so that when two barrier segments are joined, an oval hand access opening is formed, while in other exemplary embodiments, each hand access opening comprises a top edge and a side edge, so that when two barrier segments are joined, a polygonal hand access opening, wherein a bottom of the polygon is defined by the ground surface, is formed. Of course, other access opening configurations are possible, and are well within the metes and bounds of the invention.

The pin comprises a T-pin, having a top handle, and a keeper pin is disposable through a bottom end of the pin to keep it in place. A plurality of stacking lugs may be disposed on a top surface of the barrier segment, each stacking lug extending across most of a width of the barrier segment.

In another aspect of the invention, there is provided an array of hollow, fillable barrier segments adjoined end-to-end, each of the array of barrier segments comprising a molded plastic container having outer walls defining an interior volume and having a first end and a second end. A plurality of connecting lugs are disposed on each of the first and second ends, the outer walls of each barrier segment comprising side walls which extend beyond each of the first and second ends, to form a recess between the extended side walls on each of the first and second ends, a plurality of vertically spaced connecting lugs being disposed in each recess. The extended side walls of each barrier segment are flush with the extended side walls of an adjoining barrier segment, so that relative rotation of adjoining barrier segments is limited or prevented.

In some embodiments, the extended side walls of each barrier segment contact the extended side walls of an adjoining barrier segment. A hand access opening is provided at a lower end of the extended side walls between two adjoining barrier segments, the hand access opening permitting access by a user to a pin securing the connecting lugs of the adjoining barrier segments together. The hand access opening may be of a variety of configurations, such as oval in shape or polygonal in shape.

The invention, together with additional features and advantages thereof, may best be understood by reference to the following description taken in conjunction with the accompanying illustrative drawing.

BRIEF DESCRIPTION OF THE DRAWINGS

FIG. 12 is a front view similar to FIG. 3, illustrating a slightly modified exemplary embodiment of the invention;

FIG. 13 is a top view of the barrier segment shown in FIG. 12;

FIG. 14 is an isometric view of the barrier segment shown in FIGS. 12 and 13;

FIG. 15 is an end view of the barrier segment shown in FIGS. 12-14;

DESCRIPTION OF THE PREFERRED EMBODIMENT

Figure 1:
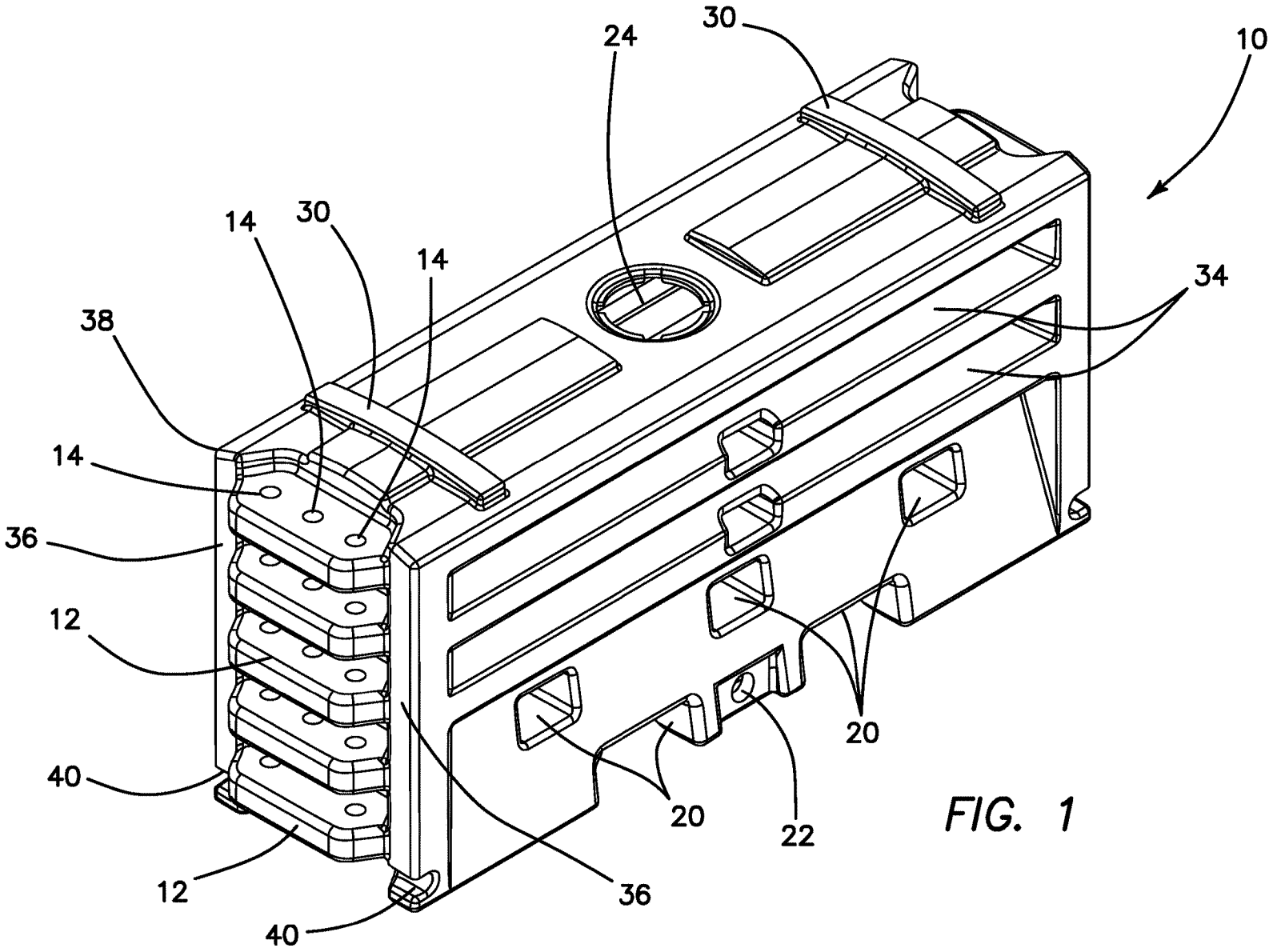
FIG. 1 is an isometric view showing a configuration of a water barrier segment constructed in accordance with one exemplary embodiment of the present invention.

Referring now more particularly to the drawings, there is shown in FIGS. 1-11 a water-ballasted barrier segment 10 constructed in accordance with one exemplary embodiment of the present invention. The illustrated barrier segment preferably has dimensions of approximately 22.5 inches in width, 34.5-35.5 inches in height, and 75.75 inches in length (pin-to-pin), with a material thickness of about ¼ in, though, of course, these values may vary within engineering design and application considerations. The length of a barrier segment 10 from knuckle end to knuckle end is approximately 82.5 inches. The material used to fabricate the segment 10 may be a high density polyethylene, and is preferably rotationally molded, although it may also be molded using other methods, such as blow molding. The segment 10 preferably has an empty weight of approximately 125-135 lb., without installed steel cables (approximately 200 lb with steel cables), and a filled weight (when filled with water ballast) of approximately 1680-1800 lb.

FIGS. 12-19 illustrate an embodiment very similar to that shown in FIGS. 1-11, except as will be described below, and common reference numerals are used to delineate common elements in each embodiment. Because of the similarity of the embodiments, they will hereinafter be discussed together, except for specific exceptions as noted.

In order to absorb the energy of a vehicle traveling at 70 to 100 kph, the inventors have found that steel components need to be incorporated into the water barrier system design. Using steel combined with a large volume of water for ballast and energy absorption enables the properly designed plastic wall to absorb the necessary energy to meet the federal crash test requirements at such an impact.

To contain the 70 to 100 kph impacting vehicle, an interlocking plastic knuckle design, comprising a plurality of male knuckles 12 on each of the left and right sides, is provided. As illustrated, there are five knuckles 12 on the left side of the barrier segment 10 and four knuckles 12 on the right side of the segment. The respective knuckles are positioned so that they interweave when two adjacent segments 10 are joined end-to-end. Approximately one-half of the length of each lug is disposed within the recess 38 of its barrier segment, so that, when two adjacent barrier segments 10 are joined together, the other half of that lug will be disposed within the recess 38 of the adjoining barrier segment, thereby permitting a flush joinder of adjacent segments. This flush joinder is shown in FIGS. 9-11 and again in FIG. 16. Each lug has a pin hole 14 disposed therethrough, which align with pin holes 14 in vertically adjacent knuckles 12 when the barrier segments are joined end-to-end. This permits a pin 16 (FIG. 12), comprising a steel drip T-pin in one exemplary embodiment, to be placed downwardly through the aligned pin holes 14 to secure the adjacent barrier segments 10 together.

Although the illustrated arrangement, wherein only about one-half of the length of a lug 12 extends beyond the extended sidewalls 36 of the barrier segment 10 from which the lug protrudes, is preferred because it creates a substantially flush joinder of adjacent barrier segments 10, thereby minimizing or eliminating relative rotation between adjoining barrier segments, modifications of this design may be permissible in some applications, as long as the relative permitted rotation is about 5 degrees or less. Generally speaking, it is desirable, therefore, that at least one-third of the length of the lug 12 be disposed within the recess 38 between the extended sidewalls 36, so that the desirable range is between ⅓ and ½ of the total lug length, and further so that no more than ⅔, and preferably about ½ of the total lug length protrudes beyond the extended sidewalls 36 of the barrier segment.

Figure 19:
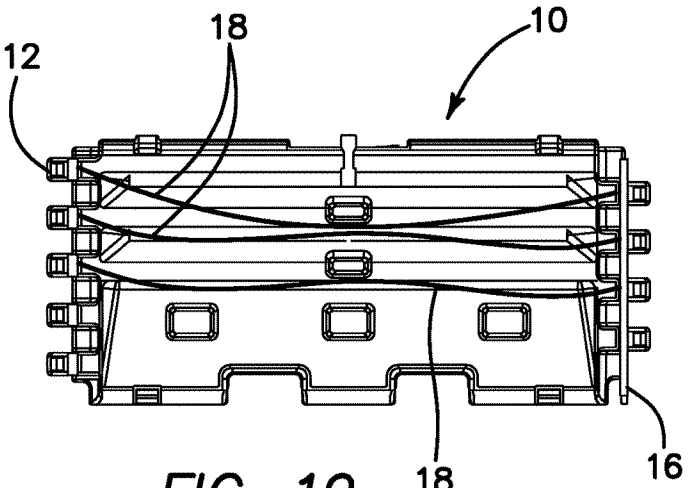
FIG. 19 is a cross-sectional view taken along lines A-A of FIG. 18.
Figure 17:
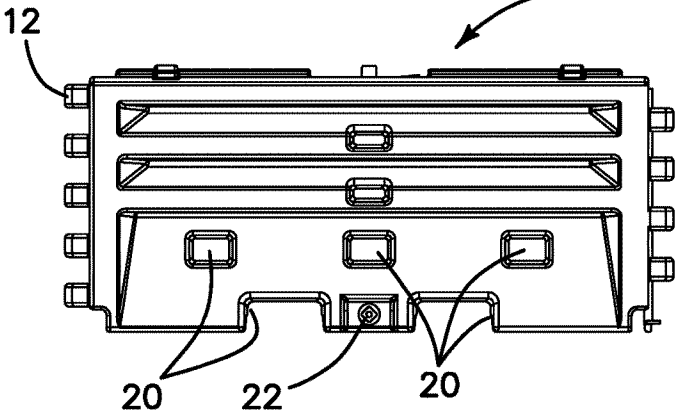
FIG. 17 is a front view similar to FIG. 12.
Figure 18:
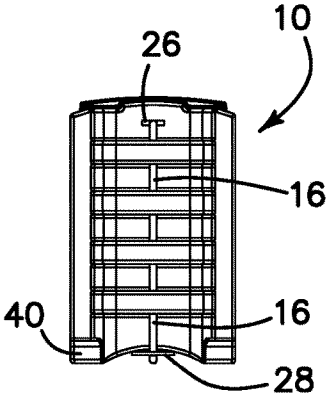
FIG. 18 is an end view similar to FIG. 15.

The barrier system described herein absorbs energy by plastic deformation, water displacement, wire rope cable fencing tensioning, water dissipation, and overall displacement of the water barrier itself. Since it is known that plastic alone cannot withstand the stringent test requirements of federal vehicular impact protocols, internally molded into the barrier segment 10 is a wire rope cable 18, which is used to create a submerged fence inside the water barrier segment 10 as shown in FIG. 19. Before the barrier segment 10 is molded, the wire rope cables 18 (three are illustrated, but four or more, or even two, could be employed) are placed inside the mold tool. In an exemplary embodiment, the wire rope cables 18 are each comprised of stainless steel, or galvanized and stranded steel wire cable to resist corrosion due to their contact with the water ballast, and are preferably formed of ⅜ inch 7×19 strands, though alternative suitable cable strands may be used as well.

Figure 16:
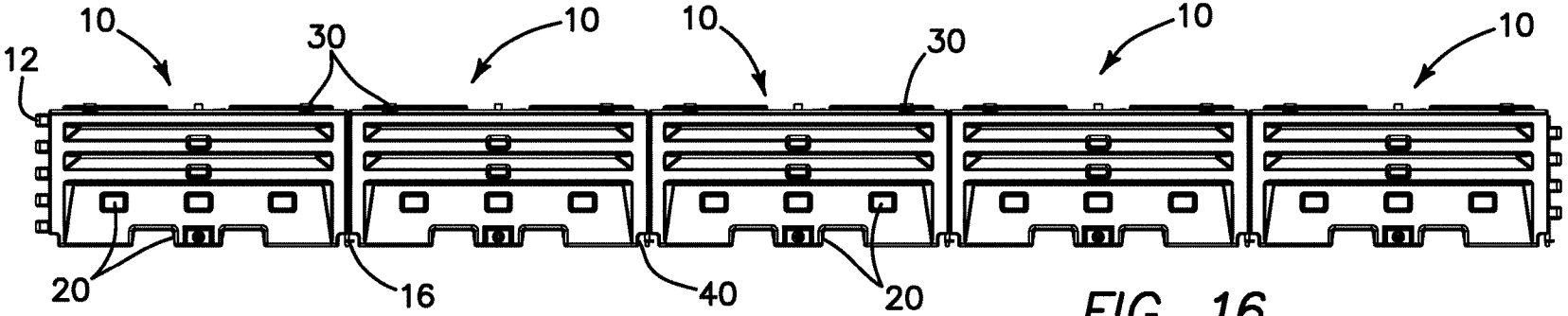
FIG. 16 is a front view of an array of joined barrier segments, illustrating the barrier segments of the embodiment of FIGS. 12-15, but which could also apply to the embodiment of FIGS. 1-11.

The wire rope cables 18 are an integral part of each barrier segment 10 when applications risking high impact velocities are contemplated, and cannot be inadvertently omitted or removed once the part has been manufactured. The current design uses up to five wire rope cables 18 per barrier segment 10. This creates a ten piece interlocking knuckle section. More or fewer knuckles and wire rope cables may be utilized, depending upon whether a lower or taller barrier is desired. When large numbers of barrier segments are used to create a longitudinal barrier, as shown in FIG. 16, a wire rope cable fence is formed, with a t-pin post, with the whole assembly being ballasted by water without seeing the cable fencing. As the barrier illustrated in FIG. 16 is impacted by a vehicle, the plastic begins to deform and break, water ballast is displaced, and water is dispersed while the wire rope cables 18 continue the work of absorbing the impact energy by pulling along the knuckles and pulling the series of wire rope cables in tension. The entire area of impact immediately becomes a wire rope cable fence in tension, holding the impacting vehicle on one side of the water ballasted barrier.

It should be noted that the barrier array of FIG. 16 may comprise the barrier segments of FIGS. 1-11 or the barrier segments of FIGS. 12-19.

Although in the exemplary embodiment, the wire rope cables 18 are important to protect the integrity of the barrier system when high impact velocities are involved, other low speed or pedestrian applications do not require the wire rope cables 18. In such embodiments, the cables 18 can be omitted, and the innovative anti-rotational features of the barrier system are still important to the usefulness of the system.

The barrier segment 10 also may comprise forklift and pallet jack lift points 20, comprising equipment lifting through holes, disposed on a bottom edge of the segment, as well as a second set of forklift lift points 20 disposed above the first set. A drain aperture 22, which may comprise a buttress thread drain plug, is disposed between the two lower lift points 20. A fill aperture 24 is disposed on a top surface of the segment, having a diameter, in one preferred embodiment, of approximately 8 inches. Advantageously, the fill aperture also comprises a lid, which is molded with fittings designed to ensure water-tight securement with an easy ¼ turn of the lid. The lid may be of the twist lock type, and the lid may further include a float water level indicator 25 (FIG. 13).

In the illustrated embodiment, the right side of each barrier segment 10 preferably includes four lugs or knuckles 12, while the left side comprises five lugs or knuckles 12. As noted above, these lugs or knuckles 12 are configured to be interleaved when two adjacent barrier segments 10 are joined, so that the pin receiving holes 14 are aligned for receiving a T-pin 16. The T-pin 16 comprises a T-pin handle 26 at its upper end, and a keeper pin 28 insertable through a hole in its lower end, as illustrated in FIGS. 12-19. To join the barrier segments 10 together, the T-pin 16 is inserted downwardly through all of the aligned holes 14. Then, the keeper pin 28 is inserted through the hole in the lower end of the pin 16, to ensure that the T-pin cannot be inadvertently removed. In a preferred embodiment, the diameter of the T-pin is approximately 1¼".

Figure 7:
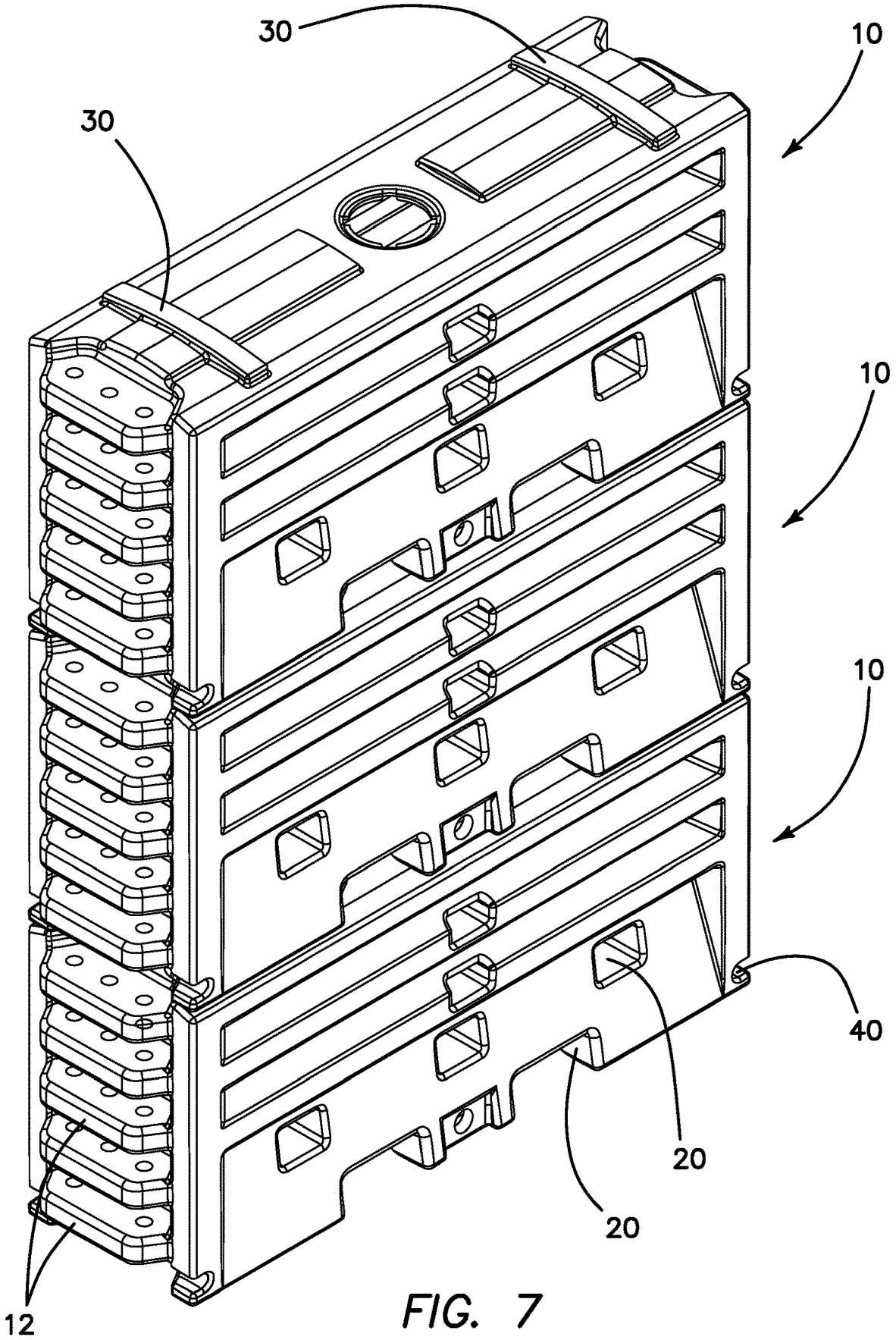
FIG. 7 is an isometric view showing a plurality of the barrier segments shown in FIGS. 1-6 in a vertically stacked configuration.
Figure 8:
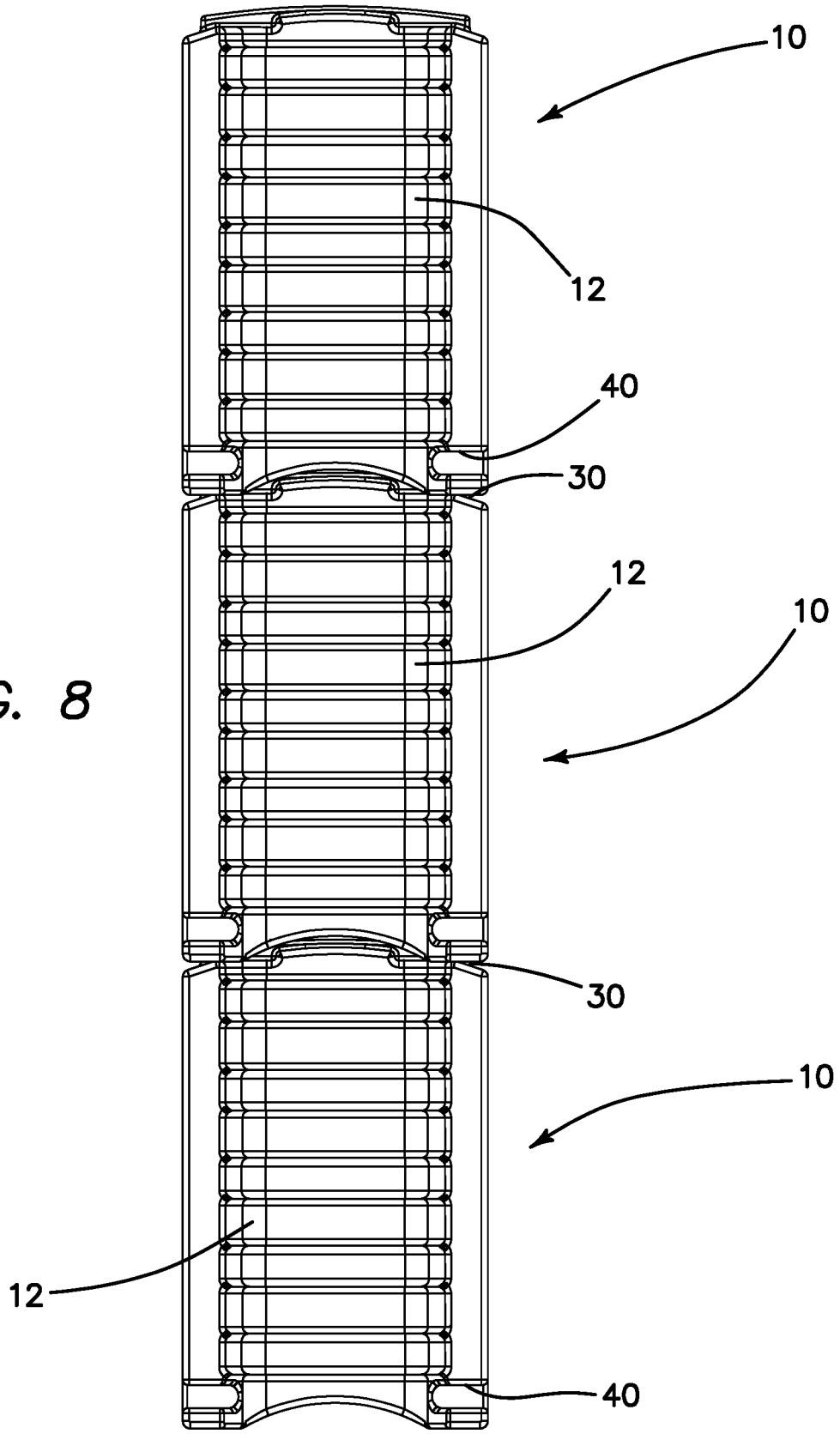
FIG. 8 is an end view of the stacked array of barrier segments shown in FIG. 7.
Figure 9:
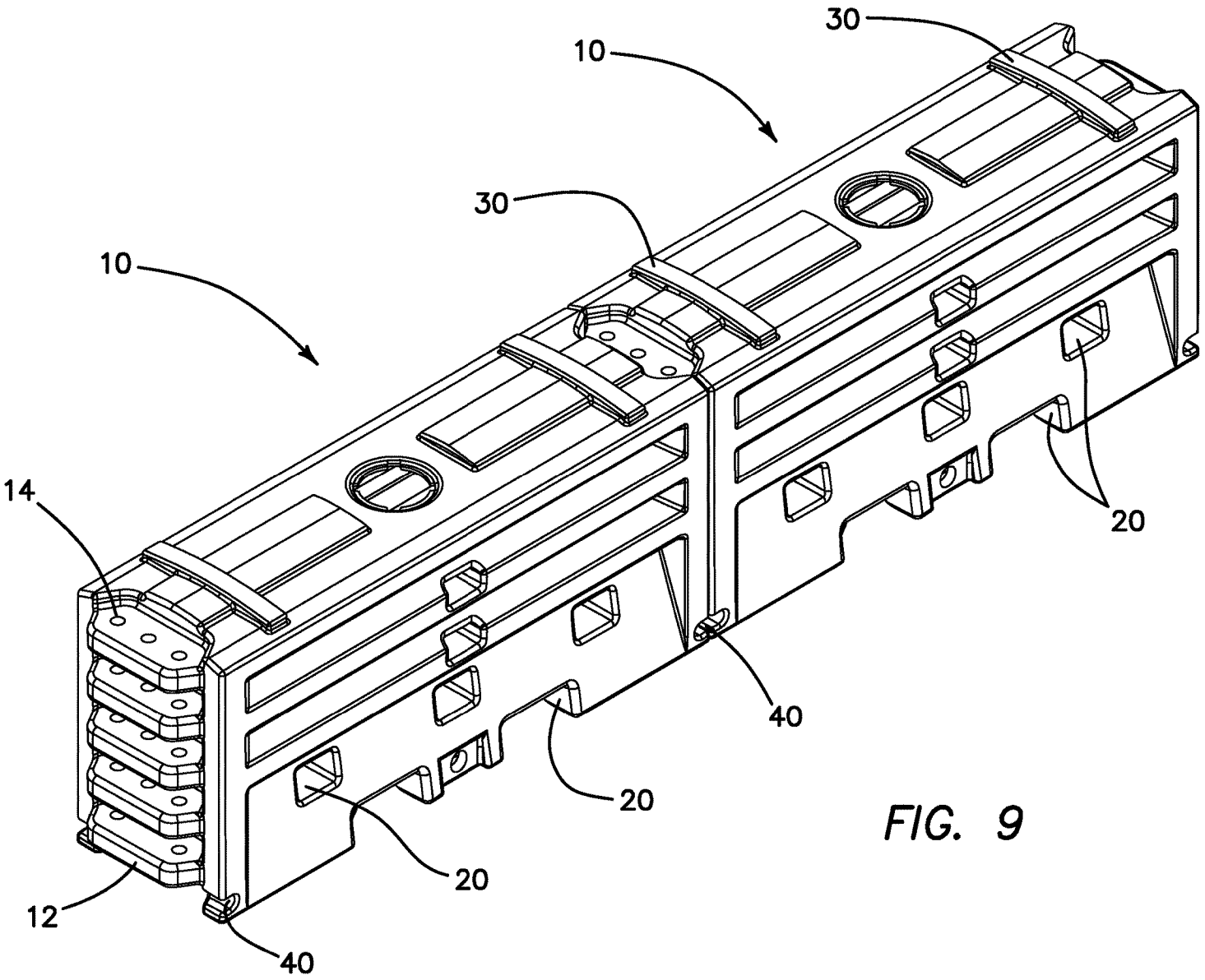
FIG. 9 is an isometric view of two barrier segments constructed in accordance with the invention, attached in an end-to-end configuration.
Figure 10:
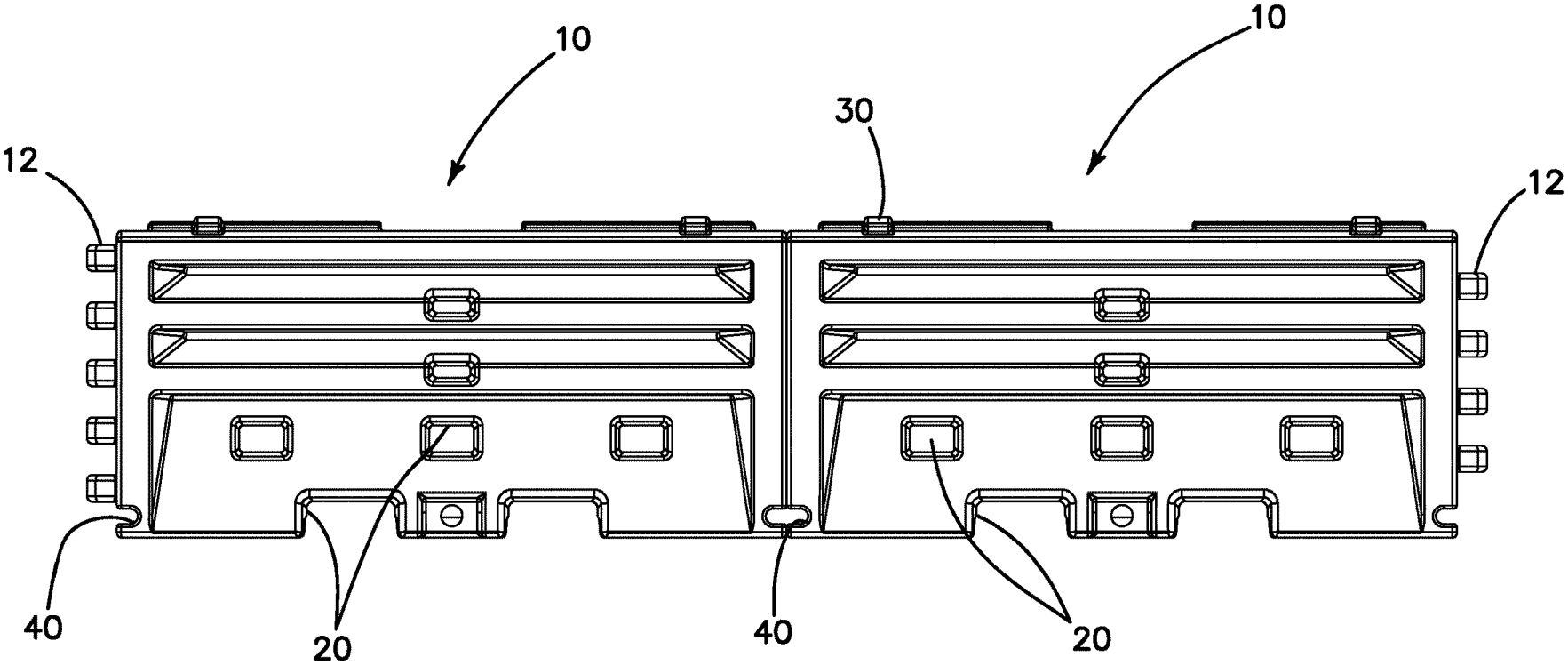
FIG. 10 is a front view of the joined barrier segments shown in FIG. 9.

Stacking lugs 30 are disposed on the top surface of each barrier segment, and corresponding molded recesses 32 are disposed in the lower surface of the barrier segment 10. Thus, as shown in FIGS. 7 and 8, the barrier segments 10 of either of the embodiments of FIG. 6 or of FIGS. 12-19 may be stacked vertically, with the stacking lugs 30 on the lower barrier segment 10 engaging with their counterpart stacking recesses 32 on the upper barrier segment 10. Two barrier segments, stacked vertically, have a total height of approximately 87 inches, in one exemplary embodiment. The stacking lugs 30 and corresponding recesses 32 uniquely extend across the entire width, or most of the entire width of the barrier segment 10, as shown, to maximize purchase between the lugs 30 and recesses 32 for secure stacking.

Sawtooth segments 34 comprise substantially flat barrier side walls, with recesses into which sawtooth segments extend, in an upward slanting direction, as shown. This results in an anti-climb function, preventing vehicles from climbing up the barricade walls upon impact, but the manufacturing process is greatly simplified with respect to conventional sawtooth segments on such barrier walls. In one preferred embodiment, the angle of slant of each sawtooth segment is approximate 43 degrees.

An actual vehicular impact produces the following energy absorbing actions on an array of barrier segments 10 as shown, for example, in FIG. 16:

1. One or more of the high density polyethylene (HDPE) barrier segments 10 which are impacted burst;
2. The water in each burst section is released and dispersed over a wide area;
3. The cables 18, if present, are engaged and prevent breaching or climbing of the barrier;
4. Many segments 10 of the barrier array remain assembled together, but are moved during the impact. They are either dragged closer to the point of impact if they are in tension, or pushed away if they are in compression.

It should be noted that relatively few barrier segments 10 will burst, depending upon the severity of the impact. Many segments in the array, however, will move and will be undamaged or have minor leaks which are readily repaired.

It is noted that there is no requirement that the barrier segment 10 be ballasted with water. Alternative ballasts, particularly if dispersible, may be utilized. It is also within the scope of the invention, particularly if a particular segment 10 is to be used as an end treatment, to fill the segment with foam. The foam would be installed during the manufacturing process, and the fill and drain apertures could be eliminated. The cables 18 could still be used in such an embodiment. Of course, in certain applications, particularly where only pedestrians or bicycles are present, the ballast may potentially be omitted.

The present invention particularly is directed to advantageous designs which minimize rotation of the barrier segments 10 with respect to one another upon impact of an array of barrier segments 10, as shown in FIG. 16, by a vehicle. Several unique features have been found by the inventors to limit relative rotation of adjacent barrier segments 10 to 5 degrees or less. A significant design advantage is that, as shown in FIGS. 1-11, each knuckle 12 may comprise a plurality of pin holes 14, rather than the single pin hole shown in the embodiment of FIGS. 13-19. In the exemplary illustrated embodiment of FIGS. 1-11, three horizontally adjacent pin holes 14 are disposed in each knuckle, and to join adjacent segments 10 together, three pins 16 are employed, one each through each set of aligned knuckle holes 14. Because the knuckles 12 are wide, extending widthwise between the side walls 36 of the barrier segment 10, and because of the three adjacent pin connections, the barrier segments 10 are constrained from substantial relative rotation when attached. Another advantageous feature is that the side walls 36 on each side of the barrier segment extend lengthwise past the end wall of the barrier segment 10 to create a large recess 38 for the knuckles. As shown in FIG. 2, the extended side walls 36 end at a point approximately at the radial center of the pin holes 14, which is the maximum possible extension in order to create a flush engagement of adjacent barrier segments when joined end-to-end, as shown particularly in FIG. 11.

Figure 2:
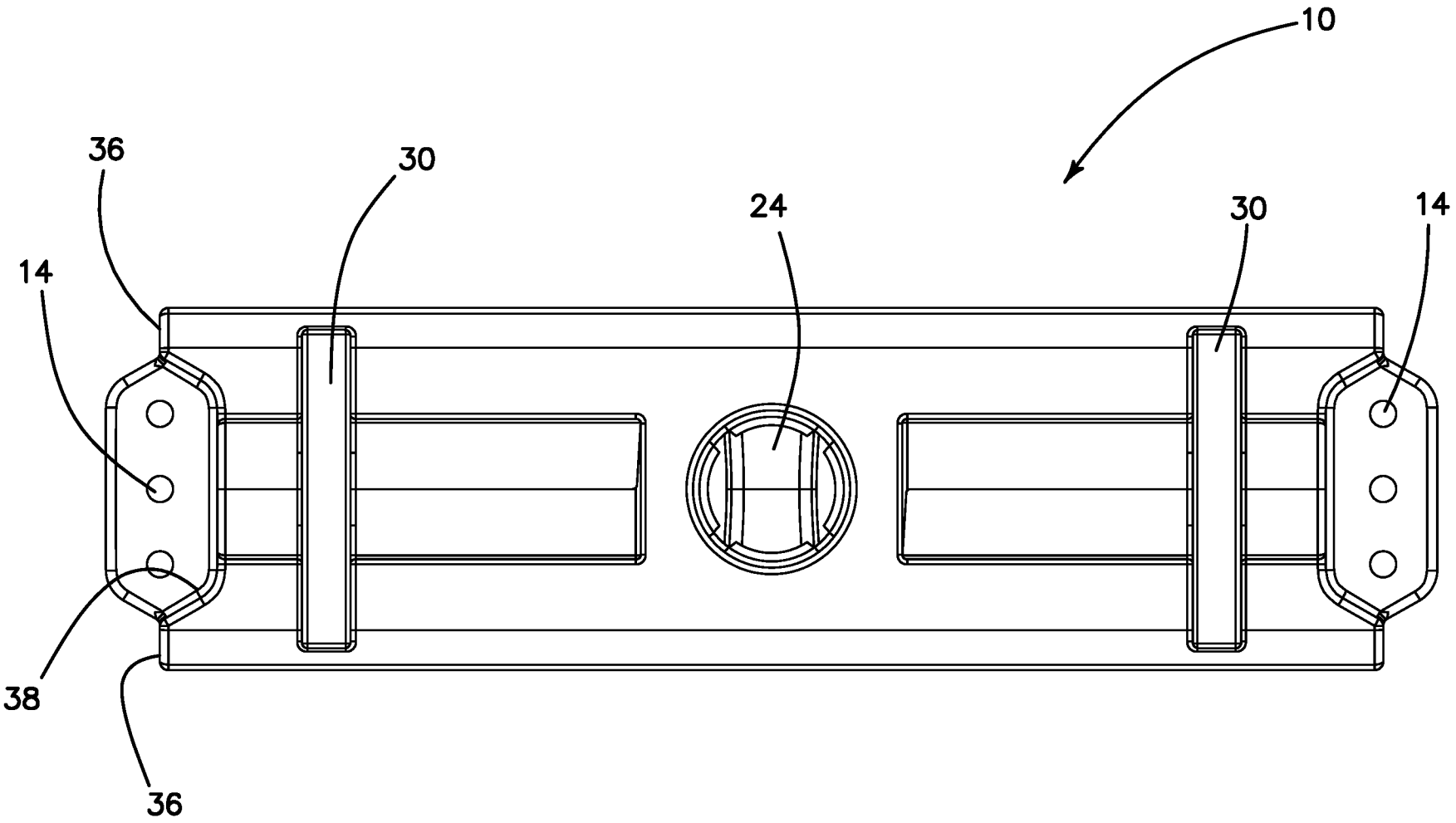
FIG. 2 is a top view of the barrier segment of FIG. 1.
Figure 3:
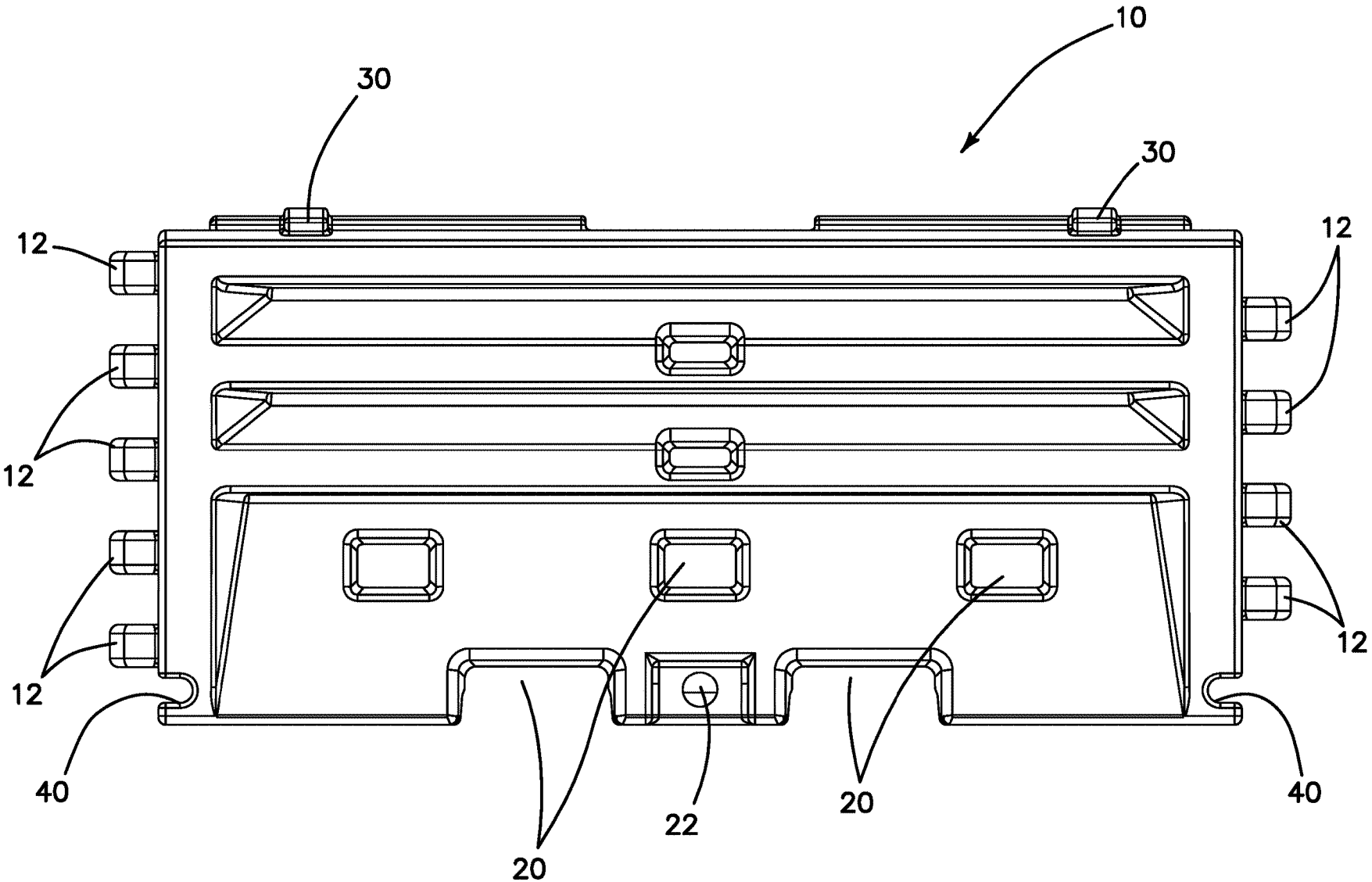
FIG. 3 is a front view of the barrier segment of FIGS. 1 and 2.
Figure 4:
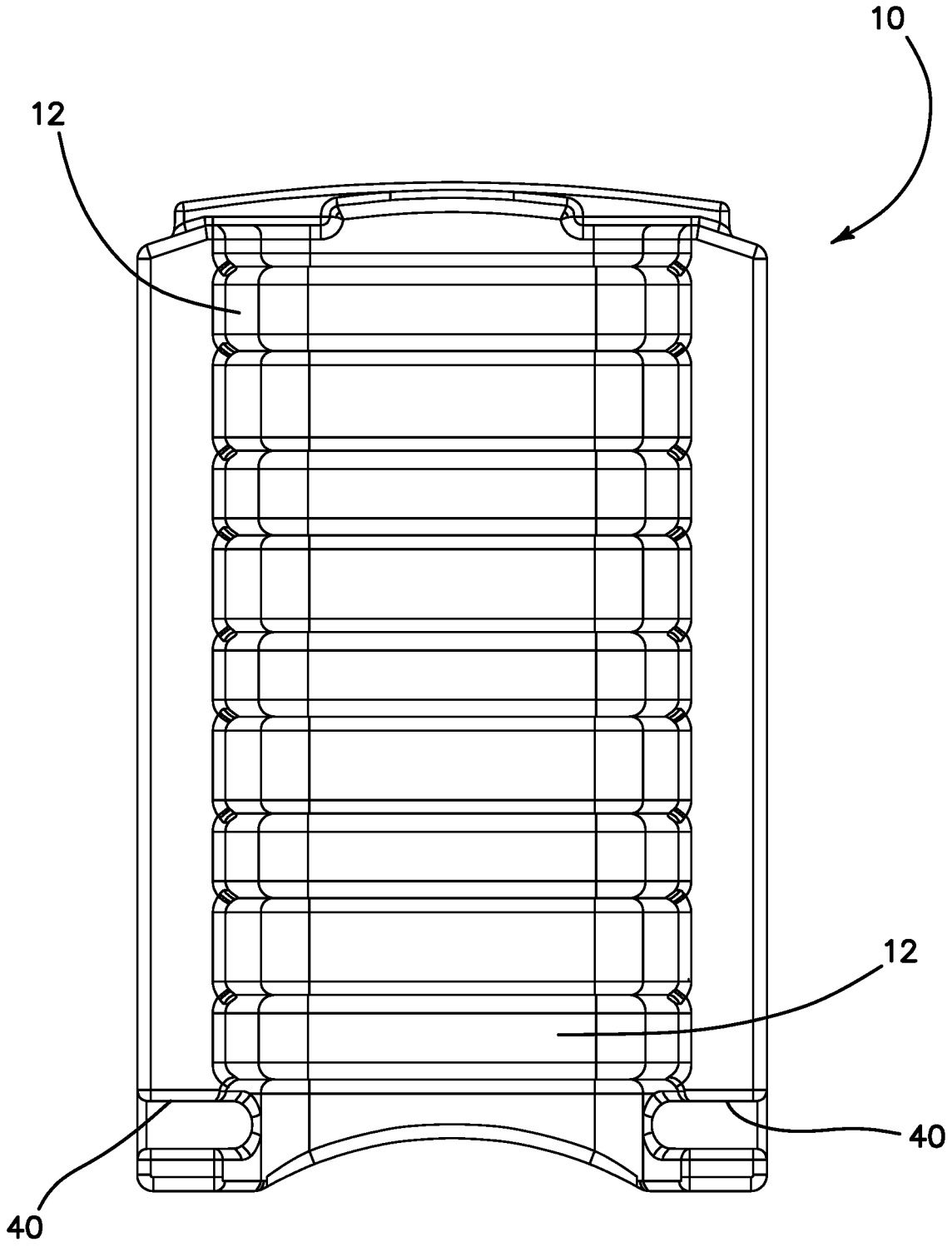
FIG. 4 is an end view of the barrier segment of FIG. 3.
Figure 5:
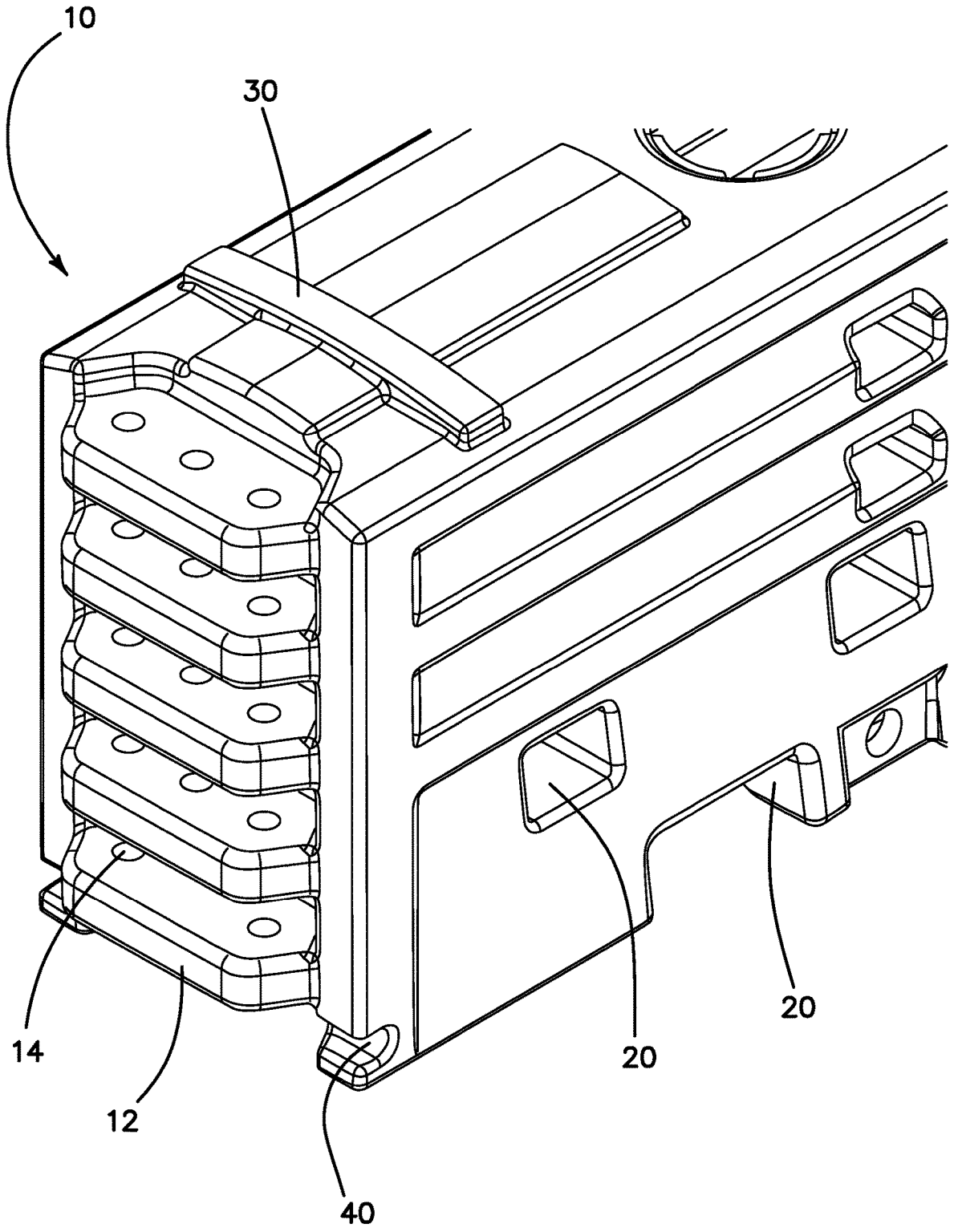
FIG. 5 is an isometric view similar to FIG. 1 of the left-hand portion of the water barrier segment shown in FIG. 1.
Figure 6:
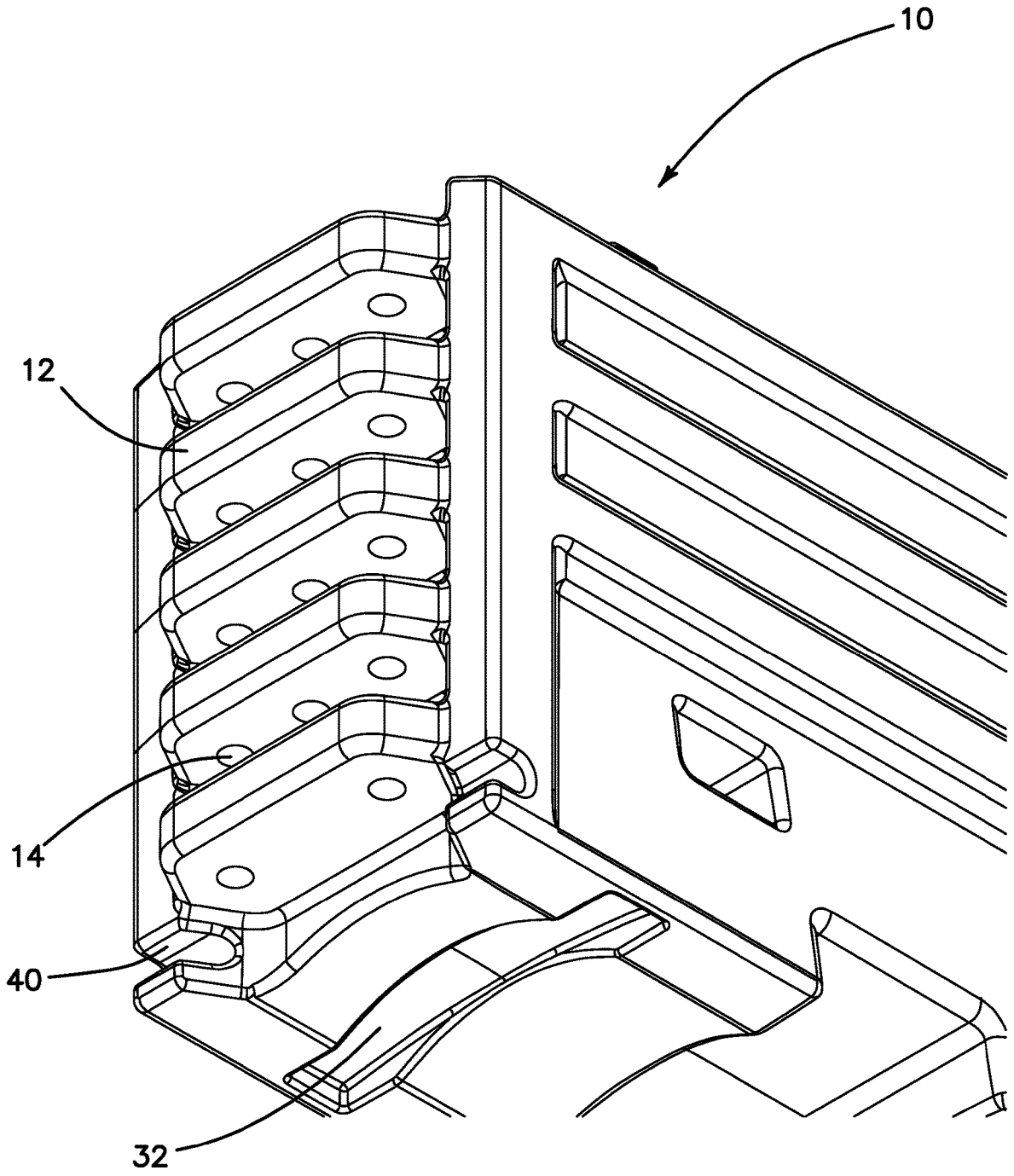
FIG. 6 is an isometric view similar to FIG. 5, but re-oriented to show the bottom of the barrier segment.
Figure 11:
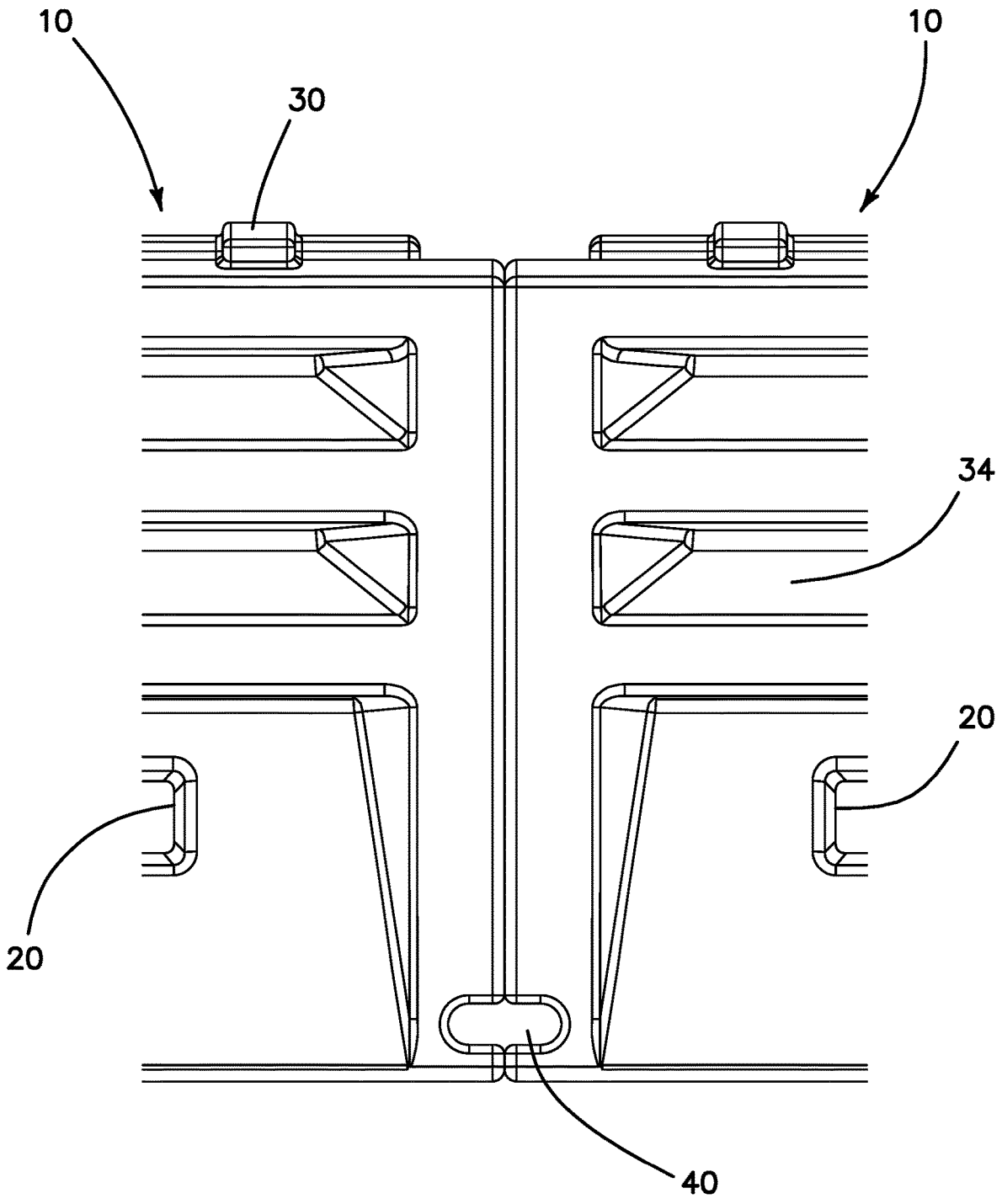
FIG. 11 is an enlarged view of the joined portions of the barrier segments shown in FIGS. 9 and 10.

Because of the extended side walls 36, a hand access opening 40 may be disposed in each side wall 36, as shown in FIG. 1. When adjacent segments 10 are joined, as shown in FIG. 11, the opening 40 forms an oval. The purpose of this opening 40 is to permit access of a user's hand into the adjoined recesses 38 for the purpose of installing or uninstalling the keeper pin 28. In the embodiment shown in FIGS. 13-19, the hand access opening 40 is somewhat differently configured, having a top edge and a side edge, so that when adjacent segments 10 are joined, the opening 40 will be polygonal in nature, with the ground forming the lower lengthwise side.

Accordingly, although an exemplary embodiment of the invention has been shown and described, it is to be understood that all the terms used herein are descriptive rather than limiting, and that many changes, modifications, and substitutions may be made by one having ordinary skill in the art without departing from the spirit and scope of the invention.

What is claimed is:

1. A hollow barrier segment which is fillable with a ballasting material for use in assembling an array of hollow barrier segments attached end-to-end to form a barrier wall, the barrier segment comprising:

a molded plastic container having outer walls defining an interior volume and having a first end and a second end;

a plurality of connecting lugs disposed on each of said first and second ends, so that a plurality of barrier segments may be joined together end-to-end;

the outer walls comprising side walls which extend beyond each of the first and second ends, to form a recess between the extended side walls on each of the first and second ends; and a hand access opening disposed on a lower end of each extended side wall, each hand access opening comprises a half-oval, so that when two barrier segments are joined, an oval hand access opening is formed.

2. The hollow barrier segment as recited in claim 1, wherein when the hollow barrier segment is joined to another hollow barrier segment end-to-end, the extended side walls of one of the joined barrier segments contact the extended side walls of the other of the joined barrier segments contact one another to create a flush engagement of the joined barrier segments.

3. The hollow barrier segment as recited in claim 1, wherein when the hollow barrier segment is joined to another hollow barrier segment end-to-end, the extended side walls of one of the joined barrier segments are sufficiently close to engagement with the extended side walls of the other of the joined barrier segments so that a relative rotation of the joined barrier segments cannot exceed 5 degrees.

4. The hollow barrier segment as recited in claim 1, wherein a width of each of the connecting lugs extends across an entire width of the recess within which the connecting lugs are disposed, so that each of the connecting lugs joins the extended side walls of the hollow barrier segment.

5. The hollow barrier segment as recited in claim 1, and further comprising a plurality of stacking lugs disposed on a top surface of the barrier segment, each stacking lug extending across most of a width of the barrier segment.

6. The hollow barrier segment as recited in claim 1, and further comprising a hole disposed in each connecting lug for receiving a pin to secure the connecting lugs of adjoining barrier segments together.

7. The hollow barrier segment as recited in claim 6, wherein the pin comprises a T-pin, having a top handle, and a keeper pin is disposable through a bottom end of the pin to keep it in place.

8. The hollow barrier segment as recited in claim 6, wherein each connecting lug comprises a plurality of spaced holes for receiving a plurality of pins to secure the connecting lugs of adjoining barrier segments together.

9. The hollow barrier segment as recited in claim 8, wherein the plurality of spaced holes comprises three spaced holes.

10. The hollow barrier segment as recited in claim 1, wherein the connecting lugs each have a length, at least one-third of the length of each.

11. The hollow barrier segment as recited in claim 10, wherein between one-third and one-half of the length of each connecting lug is disposed between the extended side walls within the recess on either the first or the second end.

12. The hollow barrier segment as recited in claim 11, wherein about one-half of the length of each connecting lug is disposed between the extended side walls within the recess on either the first or the second end.

13. An array of hollow, fillable barrier segments adjoined end-to-end, each of the array of barrier segments comprising a molded plastic container having outer walls defining an interior volume and having a first end and a second end, a plurality of connecting lugs disposed on each of said first and second ends, the outer walls of each barrier segment comprising side walls which extend beyond each of the first and second ends, to form a recess between the extended side walls on each of the first and second ends, a plurality of vertically spaced connecting lugs being disposed in each recess;

an oval hand access opening at a lower end of the extended side walls between two adjoining barrier segments, the hand access opening permitting access by a user to a pin securing the connecting lugs of the adjoining barrier segments together;

wherein the extended side walls of each barrier segment are flush with the extended side walls of an adjoining barrier segment, so that relative rotation of adjoining barrier segments is limited or prevented.

14. The array as recited in claim 13, wherein the extended side walls of each barrier segment contact the extended side walls of an adjoining barrier segment.

15. The array as recited in claim 13, wherein at least one of the barrier segments is filled with a dispersible ballasting material comprising water or sand.

* * * * *